United States Patent [19]

Johansson

[11] Patent Number: 4,622,790

[45] Date of Patent: Nov. 18, 1986

[54] DEVICE FOR RELIEVING FLOORS ON GROUND IN BUILDINGS

[76] Inventor: Jan E. Johansson, Havberg 1, S-274 00 Skurup, Sweden

[21] Appl. No.: 716,389

[22] Filed: Mar. 27, 1985

[30] Foreign Application Priority Data

Apr. 2, 1984 [SE] Sweden ..... 8401795

[51] Int. Cl.[4] ..... E04D 27/01; E04D 27/32

[52] U.S. Cl. ..... 52/169.5; 52/169.14; 405/32

[58] Field of Search ..... 52/169.5, 169.14, 169.7; 405/36, 52, 50

[56] References Cited

U.S. PATENT DOCUMENTS

| | | | |
|---|---|---|---|
| 997,835 | 7/1911 | Lane | 52/169.5 |
| 1,320,256 | 10/1919 | McLeod | 52/169.5 |
| 2,277,286 | 3/1942 | Bechtner | 52/169.14 X |
| 2,984,050 | 5/1961 | Crooks | 52/169.5 X |
| 3,425,175 | 2/1969 | Gerde | 52/169.5 |
| 4,227,266 | 10/1980 | Russell | 52/169.5 X |
| 4,271,648 | 6/1981 | Johnson | 52/169.5 |
| 4,366,846 | 1/1983 | Curati, Jr. | 405/36 X |

FOREIGN PATENT DOCUMENTS

| | | | |
|---|---|---|---|
| 29400 | 5/1981 | European Pat. Off. | 405/36 |
| 23514 | 4/1901 | Switzerland | 405/36 |

*Primary Examiner*—Alfred C. Perham
*Attorney, Agent, or Firm*—Bacon & Thomas

[57] ABSTRACT

A device for relieving the ground floor of a building from pressure due to underground water, whereby a relieving layer is disposed between the floor and a sealing layer for preventing underground water from reaching the floor and sustaining the pressure load applied by the water.

11 Claims, 3 Drawing Figures

DEVICE FOR RELIEVING FLOORS ON GROUND IN BUILDINGS

The present invention relates to a device for relieving floors on ground in buildings.

Floors on ground in buildings lying below the underground water level are subjected to heavy loads from the underground water. The floors, preferably made of waterproof concrete, must therefore be reinforced and dimensioned in relation to the pressure generated by the underground water. Consequently, the construction of such floors is expensive and time consuming.

The object of the present invention is to provide a relieving device which permits construction of floors on ground without forming or dimensioning said floors in dependence on the pressure generated by the underground water, whereby said construction becomes quicker, easier and less expensive.

The relieving device according to the invention is hereby characterized by the fact that between the floor and a sealing layer for preventing the underground water from coming through the floor, a relieving layer is provided to carry, along with said floor, the pressure load applied onto said sealing layer by the underground water.

Figure 1:
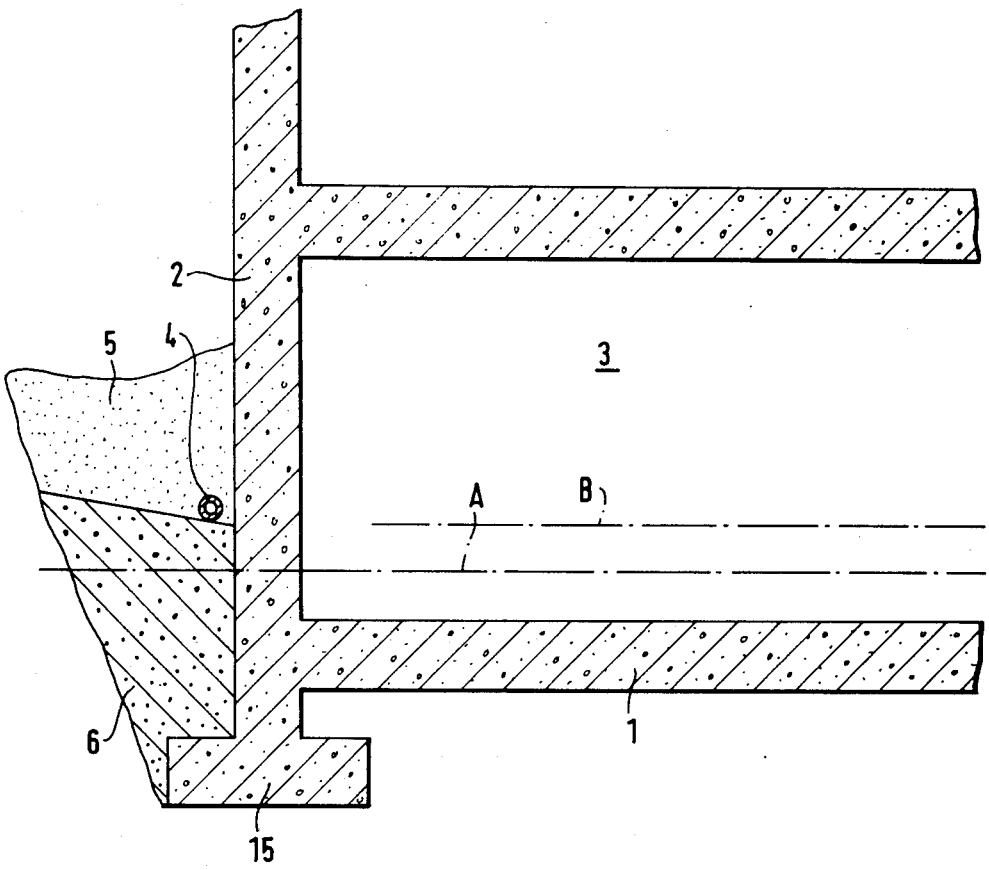
Figure 2:
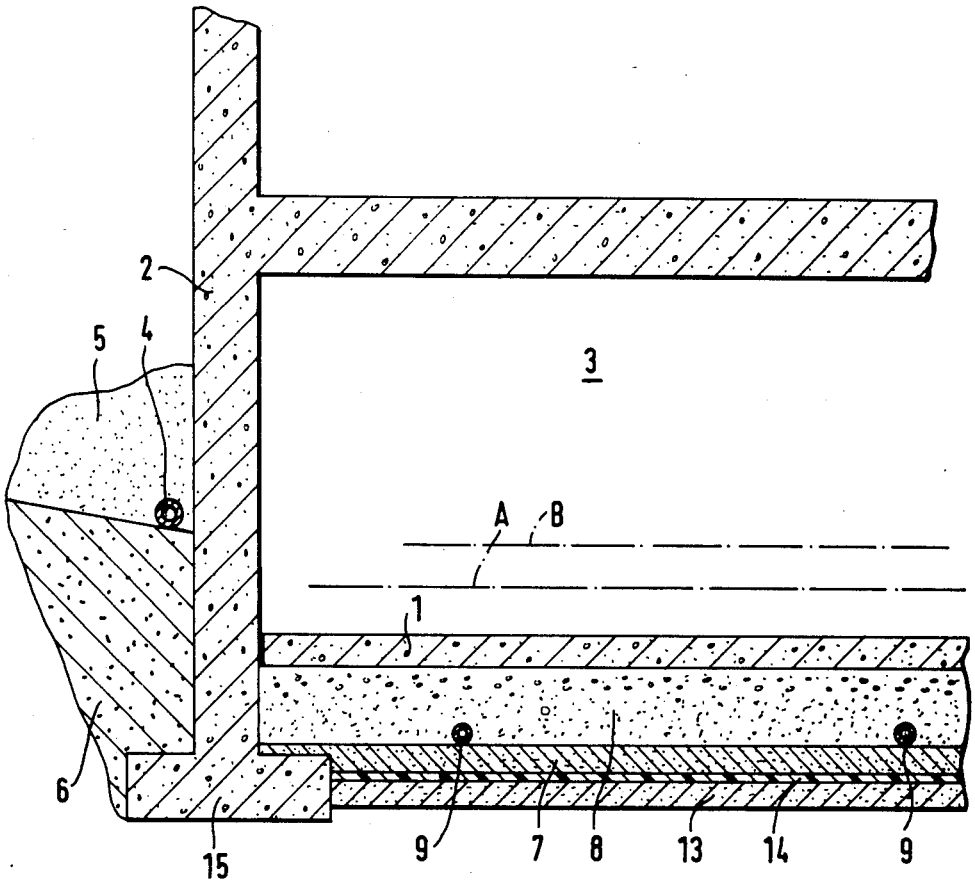
Figure 3:
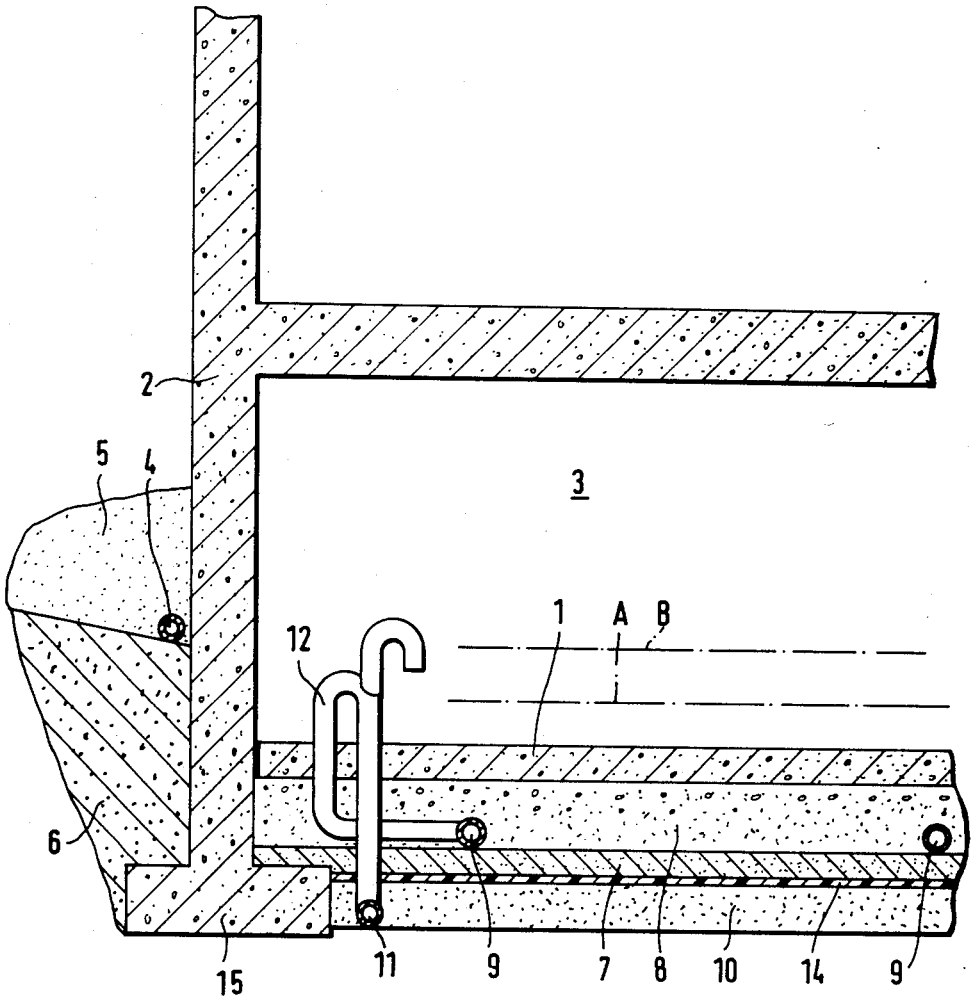

The invention will be further described below with reference to the accompanying drawings, in which FIG. 1 is a schematic section through a part of a conventional waterproof and load carrying structure;

FIG. 2 is a schematic section through a part of a building with a device according to the invention; and FIG. 3 is a schematic section through a part of a building provided with an alternative relieving device according to the invention.

FIG. 1 illustrates how a waterproof and the pressure from the underground water carrying structure is built today. The floor 1 on ground in the building is here dimensioned (about 30 cm thick) and reinforced to be able to carry the loads the underground water applies to the floor. Since the underground water level always varies, this must be done in dependence on e.g. the highest underground water level, attained every 10–20 years (illustrated with line A in FIG. 1), or exceptional underground water level, attained every 50 years (line B in FIG. 1). The floor 1 is cast in waterproof concrete, but may also be provided with a waterproof layer of another material, e.g. bitumen. Outside the wall 2 to the lowest space 3 in the building there is provided a drainage system of conventional type with draining pipes 4 in a drainage blanket 5 and a refilling or sealing material 6 underneath.

FIG. 2 illustrates a preferred embodiment of the device according to the present invention. The floor 1 on ground of concrete, not necessarily waterproof concrete, or another suitable material is here only about 10 cm thick, since it not need to be dimensioned for carrying any heavy loads. Between the floor 1 and a sealing layer 7 for preventing the underground water from coming through to the floor, a relieving layer 8 is provided in order to, along with the floor, carry the pressure load applied onto the sealing layer by the underground water. The relieving layer 8 is dimensioned after the highest underground water level A or the exceptional underground water level B and thus, is substantially thicker than the floor 1 as well as the sealing layer 7. The thickness also depend upon the weight of the material used. The relieving layer 8 has draining properties, but in order to reduce the costs, the major part thereof may comprise other heavy materials than draining material, e.g. soil, sand and/or stones. However, at least 15 cm of the relieving layer 8 closest to the floor 1 should consist of draining material.

In said relieving layer 8, or at least the part thereof consisting of draining material, there is provided a drainage system with draining pipes 9. In the embodiment of FIG. 3, the drainage system is also provided to drain a 10–15 cm thick drainage blanket 10 with draining pipes 11 positioned under the sealing layer 7, and this is done through conduits 12 which also extend up above the floor 1 and open into the space 3. The embodiment of FIG. 3 is a precautionary measure which may be taken in order to further limit the dimensioning of the relieving device, reduce the pressure on the sealing layer 7 and avoid damages on the floor 1. Pumps (not shown) may also be connected to the drainage system, but will be used only in exceptional cases.

In the embodiments of FIGS. 2 and 3, the sealing layer 7 consists of bentonite or a mixture thereof with particle shaped material such as gravel with a grain size up to about 20 mm. Bentonite has a swelling capacity and will, when mixed with water and the particle shaped material, penetrate in and seal between the grains and form a gel-like mass which is easy to handle and distribute. The bentonite mixture may be prepared in advance, but also produced in situ.

In order to further improve the sealing ability but preferably for preventing mixing of the sealing layer 7 with the relieving layer 8 and with a equalizing and/or protective layer 13 (FIG. 2) provided under the sealing layer or the drainage blanket 10 (FIG. 3) respectively, is preferably a sheet 14 of self-sealing material, e.g. a fibrous sheet of nylon, provided under and/or on top of the sealing layer.

In FIGS. 2 and 3, only the lower sheet 14 is shown. The layers 10 and 13 provide a relatively planar working surface, such that the sealing layer 7 is easily distributed or applied onto the sheet 14.

The sealing layer 7 may also consist of another material with the required properties, e.g. bitumen, clay or waterproof concrete. Furthermore, sheets or foils of e.g. plastic or rubber may be used. In the latter case, a protective layer is preferably provided on top of the foil and on top of said layer, a sheet of self-sealing material such as the sheet 14 mentioned above. Said protective layer and the equalizing or protective layer 13 are preferably 5–10 cm thick. If a foil is used, said foil may also extend downwards around the bottom 15 and then up towards the ground surface on the outside of the sealing material 6.

It is obvious for a skilled person that the present invention may be modified and changed within the scope of the following claims without departing from the idea and purpose of the invention. Thus, the indicated thicknesses of the various layers are only illustrative and may vary in dependence on which materials are used and the pressure load to be overcome. The floor 1 may also be provided with a suitable sound and/or heat insulation and it may be a floating floor or made integral with the building.

I claim:

1. Device for relieving floors on ground in buildings, characterized in that between the floor (1) and a sealing layer (7) for preventing the underground water from coming through to the floor, a relieving layer (8) is provided to carry, along with the floor, the pressure load applied onto the sealing layer by the underground water.

2. Device according to claim 1, characterized in that the relieving layer (8) is substantially thicker than the floor (1) as well as the sealing layer (7).

3. Device according to claim 1, characterized in that the relieving layer (8) has draining properities.

4. Device according to claim 3, characterized in that a drainage system (9) is provided in the relieving layer (8).

5. Device according to claim 4, characterized in that the drainage system (9, 11, 12) is further provided to drain a drainage blanket (10) under the sealing layer (7), whereby said drainage system extends up above the floor (1) and opens above said floor.

6. Device according to claim 1, characterized in that the sealing layer (7) comprises gel forming, swellable material, mixed with particle shaped material, e.g. gravel with a grain size of up to about 20 mm.

7. Device according to claim 6, characterized in that the gel forming, swellable material is bentonite.

8. Device according to claim 1, characterized in that the sealing layer (7) consists of waterproof concrete.

9. Device according to claim 1, characterized in that a sheet (14) of self-sealing material is provided under and/or above the sealing layer (7).

10. Device according to claim 1, characterized in that the sealing layer (7) consists of a sheet or foil of plastic or rubber and that a protective layer and a sheet of self-sealing material are provided on top of said foil.

11. Device according to claim 1, characterized in that the sealing layer (7) is provided on top of an equalizing and/or protective layer (13).

* * * * *